US005713696A

United States Patent [19]

Horvath et al.

[11] Patent Number: 5,713,696

[45] Date of Patent: Feb. 3, 1998

[54] ELASTICIZED GEOSYNTHETIC PANEL AND GEOFOAM COMPOSITION

[76] Inventors: John S. Horvath, 148 Johnson Rd., Scarsdale, N.Y. 10583; John D. Van Wagoner, 8554 George Town Pike, McLean, Va. 22102

[21] Appl. No.: 736,638

[22] Filed: Oct. 24, 1996

[51] Int. Cl.[6] ..... E02B 11/00; E02D 31/02

[52] U.S. Cl. ..... 405/45; 405/50; 405/36; 52/169.5; 52/169.14; 264/321

[58] Field of Search ..... 405/36, 43, 45, 405/50, 284–287; 52/169.5, 169.11, 169.14; 264/321, 320, 310

[56] References Cited

U.S. PATENT DOCUMENTS

| | | | |
|---|---|---|---|
| 3,159,700 | 12/1964 | Nakamura | 264/321 |
| 3,334,169 | 8/1967 | Erceg et al. | 264/321 |
| 4,309,855 | 1/1982 | Pate et al. | 405/45 X |
| 4,510,268 | 4/1985 | Tonokakwa et al. | 264/321 X |
| 4,704,048 | 11/1987 | Ahigrimm | 405/45 |
| 4,730,953 | 3/1988 | Tarko | 405/45 |
| 4,943,185 | 7/1990 | McGuckin et al. | 405/45 |
| 5,100,258 | 3/1992 | Van Wagoner | 405/45 |
| 5,102,260 | 4/1992 | Horvath et al. . | |
| 5,520,873 | 5/1996 | Liene | 264/321 X |

OTHER PUBLICATIONS

Rodney P. McAffee, *Geofoam as Lightweight Embankment Fill*, Apr. 1993.

*Primary Examiner*—Tamara L. Graysay
*Assistant Examiner*—Frederick L. Lagman
*Attorney, Agent, or Firm*—Bradford E. Kile

[57] ABSTRACT

An elasticized geosynthetic panel, geofoam composition and method operable for permitting controlled deformation of earth materials adjacent a rigid earth retaining structure or the like. The panel includes a drainage component, a water and gas membrane and a compressible geofoam member. The compressible geofoam member is elasticized and exhibits a cross-anisotrophic characteristic which has enhanced elasticity in a direction normal to the geosynthetic panel.

8 Claims, 3 Drawing Sheets

ELASTICIZED GEOSYNTHETIC PANEL AND GEOFOAM COMPOSITION

RELATED PATENT

This application relates to applicants' prior U.S. Pat. No. 5,102,260 entitled "Geoinclusion Method and Composite.

BACKGROUND OF THE INVENTION

This invention relates to a novel geosynthetic panel, a geofoam composition and method for reducing earth stresses acting on relatively rigid earth retaining structures. More specifically, this invention relates to an elasticized geosynthetic panel, a geofoam composition and method for allowing mobilization of earth materials adjacent earth retaining structures such as retaining walls, subterranean walls, bridge abutments, navigation locks, concrete Pipes, culverts, small diameter tunnels, landscaping installations, and the like.

Earth retaining structures are typically composed of reinforced concrete or other suitable rigid materials that prevent or restrict deformation of soil compositions retained by such structures. Because retaining structures are constructed from rigid materials, large horizontal at-rest stresses may develop. At-rest earth pressures can be 50% to 60% larger than active state forces. At-rest earth forces can cause cracking, bowing, or even collapse of a structure. Consequently rigid earth retaining structures entail high initial cost to include factors of safety and still may require substantial maintenance and, in some instances, periodic replacement. At-rest, lateral, earth forces acting on a rigid structure could be reduced if it were possible to control soil particle movement and concomitantly induce shear strength mobilization within retained soil formations.

In addition to at-rest earth forces, additional horizontal stresses may be caused by surface surcharge loads. For example, there are many situations, particularly in the transportation field, where a surface surcharge load is added adjacent to an existing wall. This could involve loads from motor vehicles, aircraft, or trains adjacent to a bridge abutment or retaining wall that significantly exceeds an original design load.

In certain regions of the world seismic activity is a significant design consideration. For non-yielding structures a seismic loading increment can be 200% to 300% that of a yielding structure. This relative increase is dramatically greater than the previously noted 50% to 60% increase for mere at-rest verses active conditions under gravity loading. However, there would be a significant benefit to allowing retained soil to deform sufficiently to mobilize its shear strength under seismic shaking, even against a non-yielding structure. Moreover there are regions of the world that were traditionally considered aseismic, such as the East Coast of the United States. In such regions it would be useful to be able to economically upgrade existing structures to meet modern seismic requirements.

Still further there are instances where horizontal movement of an earth retaining structure occurs. If a retaining structure moves, pressure on adjacent soil is increased. A traditional solution has been to design the structure for increased earth pressures. An alternative solution which would be less costly would permit the structure to move yet transmit a reduced amount of movement to the retained soil. This allows the structure to be designed for smaller lateral earth pressures.

The problems addressed above relate to lateral loading of earth retaining structures and the benefits envisioned by shear strength mobilization of soils to accommodate horizontal stresses. It has been found, however, that a need also exists to address vertical soil forces. One problem involves a need to reduce settlement of backfill and fill behind bridge abutments. A similar problem occurs with railway bridges. In addition vertical displacement can occur over a pipe, culvert or small-diameter tunnels and the like. It would be highly desirable to promote shear strength mobilization through controlled yielding in a vertical direction to accommodate the above noted conditions.

Finally there are situations where volume changes of earth materials are caused by physical changes within the material which are not associated directly with shear strength mobilization. Examples include soils that expand due to water absorption or freezing or rocks that expand due to mineral changes caused by chemical weathering or release of tectonic stresses. When such changing earth materials are adjacent rigid retaining structures the stresses generated by expanding soil or rock structures can be significant and damage the retaining structure. The detrimental effects of expansive or swelling soils is a particular problem worldwide, including many parts of the United States. It would therefore be highly desirable to permit a degree of soil expansion and therefore transmitting only a fraction of the stress to an adjacent retaining structure.

One technique envisioned for limiting soil stress has been to place synthetic reinforcement materials within earth materials retained by a structure. However, this design has met with uneven success as the rigidity of the retaining structure prevents the soil from deforming horizontally. It is necessary for such reinforcements to stretch in order to be activated. Another option employed in the past has been to leave a void next to the soil-side face of a retaining structure. This void creates an area for horizontal deformation of the earth materials. However, a void having an adequate width can be difficult to create during construction, and may result in maintenance or other operational problems after a wall is in service. In some instances fill materials have been utilized such as straw bales, cardboard, waste tires, woodchips, etc. These materials tend to be variable in their make-up and subject to poor engineering due to field execution variables. They also are subject to limitations in handling and can be weather sensitive.

A significant contribution in the art was realized by the development of applicants' invention of a geoinclusion composite as discussed in the above referenced U.S. Pat. No. 5,102,260. This patent discloses a composite panel which includes a compression component to allow earth materials to deform horizontally adjacent earth retaining structures. While this design is significant, it falls short of the full scope of the present invention.

The difficulties suggested in the preceding are not intended to be exhaustive but rather are among many that may tend to increase the cost and/or reduce the effectiveness of rigid earth retaining structures. Other noteworthy problems may also exist; however, those presented above should be sufficient to demonstrate that designs and techniques for protecting earth retaining structures appearing in the past will admit to worthwhile improvement.

OBJECTS AND BRIEF SUMMARY OF THE INVENTION

Objects

It is therefore a general object of the invention to provide a novel elasticized geosynthetic panel, geofoam composition and method that will obviate or minimize difficulties of the type previously described.

It is a specific object of the invention to provide a novel elasticized geosynthetic panel, geofoam composition and method that permits retained earth materials, with or without synthetic reinforcement, to deform horizontally and develop shear strength, without providing significant resistance to this deformation, thereby reducing horizontal stress to a rigid earth retaining structure and improving the stability of the structure.

It is a specific object of the invention to provide a novel elasticized geosynthetic panel, geofoam composition and method that will exhibit enhanced resilience in a design direction to provide a generally firm but moveable interface between a rigid earth retaining structure and adjacent soils.

It is another object of the invention to provide a novel elasticized geosynthetic panel containing a layer of elasticized expanded polystyrene that permits earth mobilization within retained soil formations.

It is still another object of the invention to provide a novel elasticized geosynthetic panel, geofoam composition and method that will thermally insulate an earth retaining structure form a surrounding earth environment.

It is a further object of the invention to provide a novel elasticized geosynthetic panel, geofoam composition and method that will attenuate transmission of noise and vibrations between earth materials and a subterranean wall, retaining wall, or the like.

It is yet a further object of the invention to provide a novel elasticized geosynthetic panel, geofoam composition and method that is lightweight and, therefore, easy to transport and install.

It is still a further object of the invention to provide a novel elasticized geosynthetic panel, geofoam composition and method that will not degrade in situ and is biocompatible with chemicals in the soil.

It is yet still another object of the invention to provide a novel elasticized geofoam composition is inexpensive to produce and easily manufactured.

BRIEF SUMMARY OF A PREFERRED EMBODIMENT OF THE INVENTION

A preferred embodiment of the invention that is intended to accomplish at least some of the foregoing objects comprises a geosynthetic panel containing a layer of elasticized expanded polystyrene formed for placement adjacent to an earth retaining structure. This elasticized geosynthetic panel exhibits enhanced resilience for accommodating horizontal deformation of retained earth materials. The subject geosynthetic composite includes a compressible layer of elasticized, cross-anisotropic, expanded polystyrene. A drainage layer having a higher density than the compressible layer is positioned upon and coextensive with the compressible layer. The drainage layer includes voids that permit the passage of water or other fluids to relieve hydrostatic pressure against the wall surface.

In addition to the compressible layer of elasticized expanded polystyrene and the drainage layer, the subject geosynthetic composite includes a water permeable membrane that extends parallel to and is generally coextensive with the drainage layer. The water permeable membrane is composed of a woven or non-woven geotextile that operably restricts earth particles from entering the drainage layer and enhances development of a natural filtration zone within the adjacent earth materials.

The subject geosynthetic composite operably permits retained earth materials to deform, and mobilize shear strength, without providing significant resistance to advantageously utilize the inherent shear strength of the earth material to reduce lateral or vertical stresses imposed upon a retaining structure.

THE DRAWINGS

Other objects and advantages of the present invention will become apparent from the following detailed description of a preferred embodiment thereof, taken in conjunction with the accompanying drawings, wherein.

Figure 4:
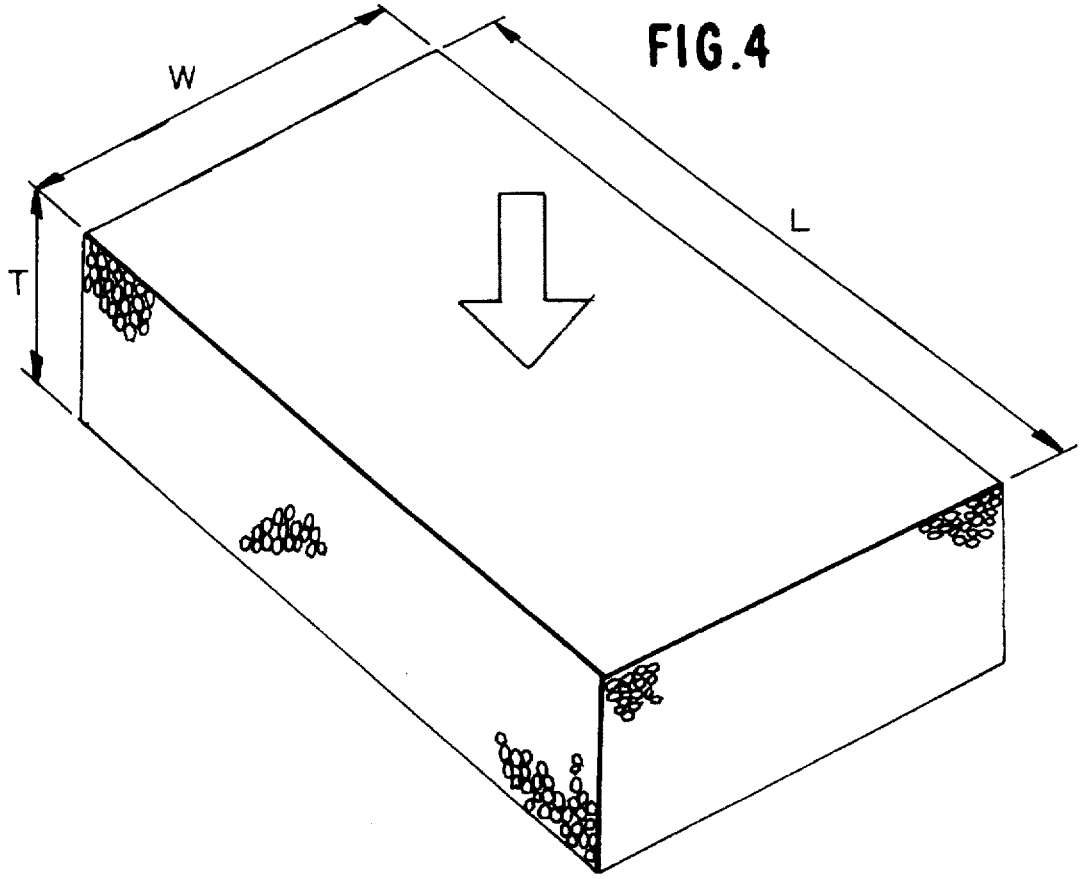
Figure 8:
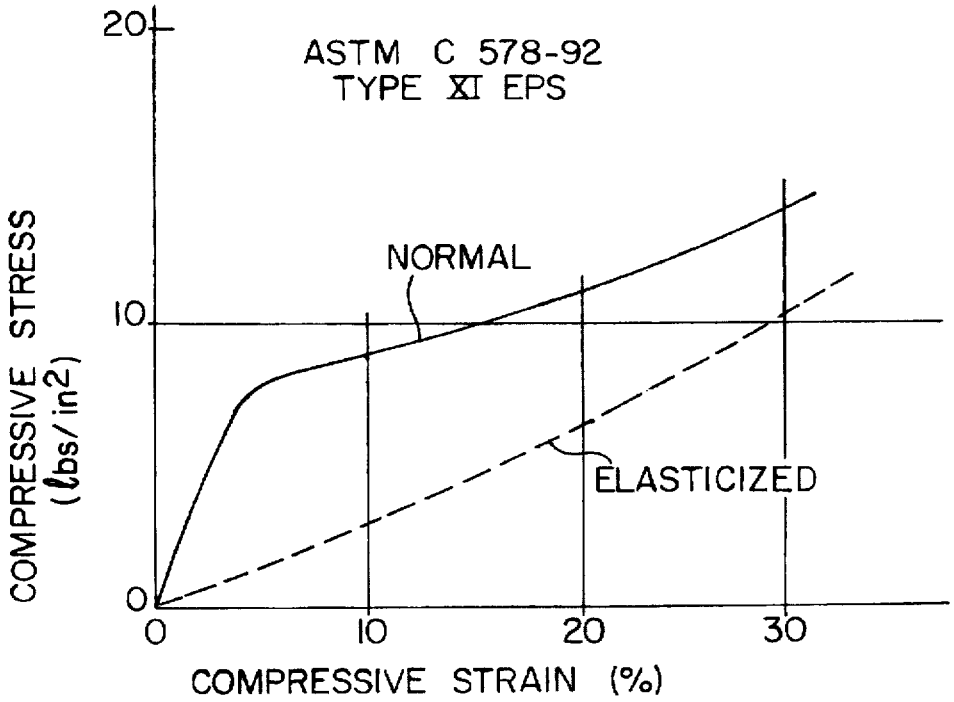
Figure 5:
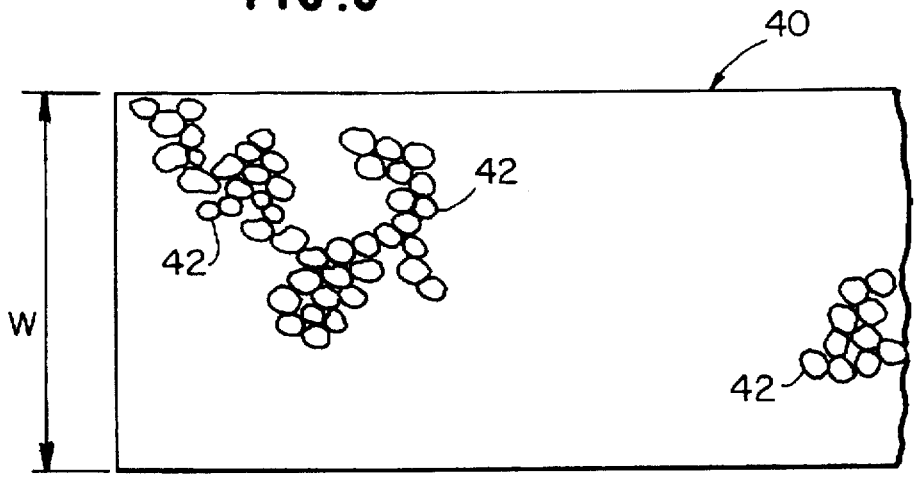
Figure 6:
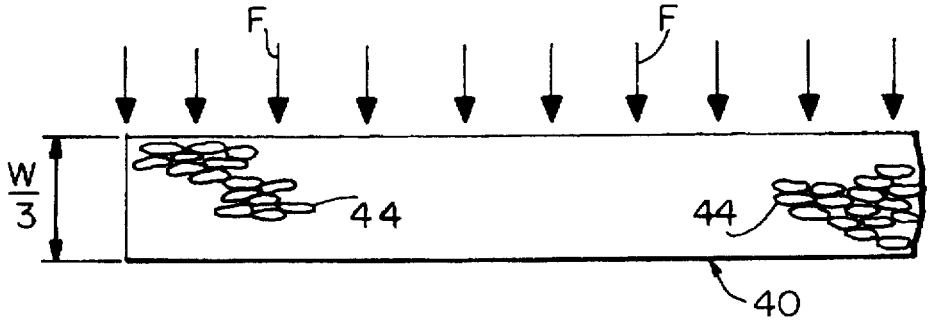
Figure 7:
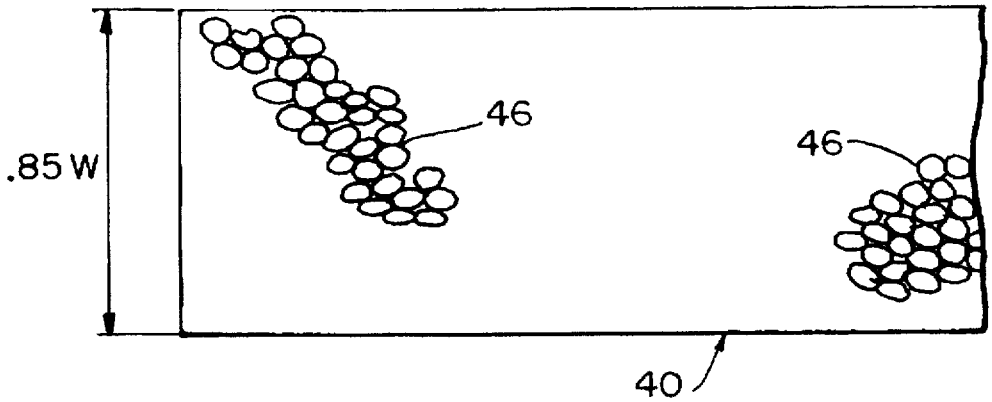

FIG. 4, note sheet 3, is an axonometric view of a geofoam block of expanded polystyrene having a length, width and thickness dimension prior to elasticizing compression in accordance with one aspect of the invention;

FIG. 5, note again sheet 2, is a side elevational view of a segment of a geofoam block of expanded polystyrene, as depicted in FIG. 4, prior to an elasticizing process;

FIG. 6 is a side elevational view of the segment of the geofoam block disclosed in FIG. 5 wherein the expanded polystyrene block has been compressed to generally two-thirds layer of its original thickness, in accordance with a preferred embodiment of the invention, providing the elasticizing process;

FIG. 7 is a side elevational view of the segment of the geofoam disclosed in FIGS. 5 and 6 wherein the compressive forces have been released and the geofoam has rebounded to 85% of its original thickness following the elasticization process in accordance with a preferred embodiment of the invention; and FIG. 8 is a graph of compressive stress (pounds per square inch) versus compressive strain (%) for normal (uncompressed) and elasticized (compressed) expanded polystyrene in accordance with the subject invention.

DETAILED DESCRIPTION

Context of the Invention

Before discussing in detail a preferred embodiment of the subject elasticized geosynthetic panel, geofoam composition and method, it may be useful to briefly define an operative environment of the invention. Referring to the drawings, wherein like numerals indicate like parts, and initially to FIG. 1, there will be seen a rigid earth retaining wall 10 that may be composed of cinder block, poured or precast concrete, or the like. Such walls typically are used along roadways, landscaping sites, and the like and often rest upon a concrete footing 12. In order to reduce hydrostatic pressure buildup on an exterior surface of the wall, a porous fluid handling conduit 14 is positioned adjacent the footing for collecting and directing water or other fluids from the earth formation 16 away from the wall. An aggregate material composed of gravel or crushed rock 18 surrounds the fluid handling conduit and facilitates flow of water into the drainage system.

The earth formation 16, which may or may not contain synthetic reinforcements, abuts against the rigid wall 10, and produces at-rest horizontal stresses against the subterranean wall. This earth formation may also transmit stresses from surface surloads.

Figure 1:
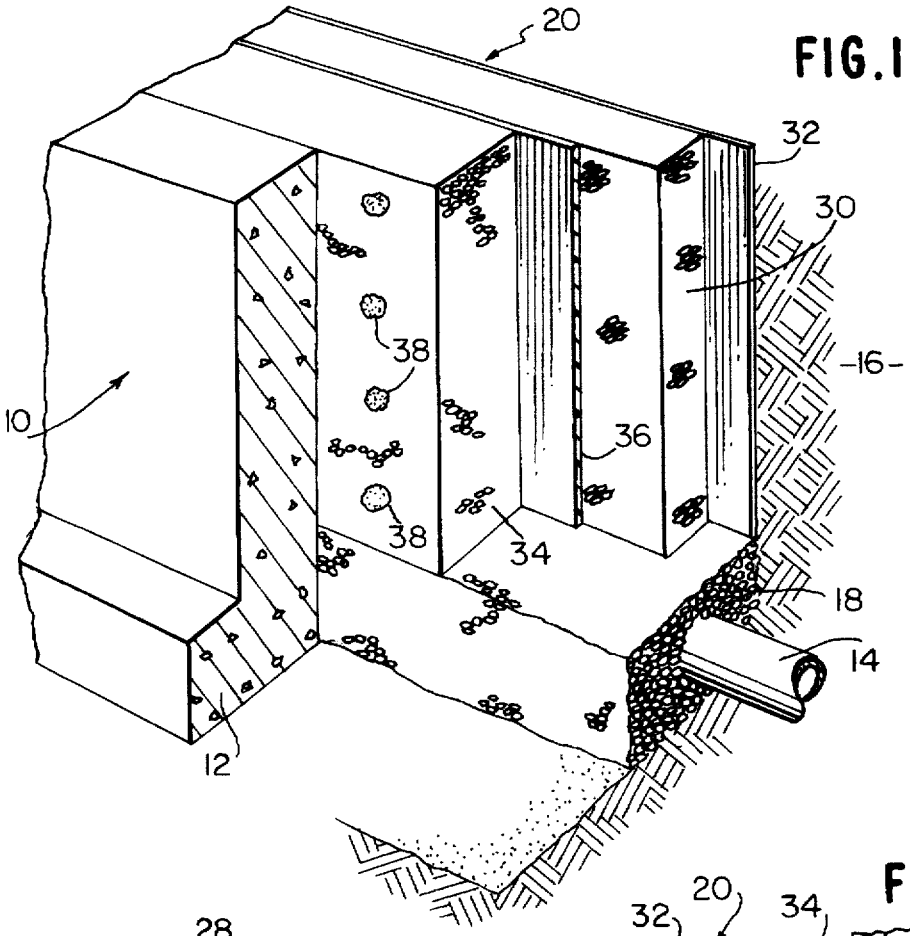
FIG. 1 is an axonometric view disclosing a context of the subject invention and depicts an elasticized geosynthetic panel composite containing a layer of elasticized expanded polystyrene in accordance with a preferred embodiment of the invention placed adjacent a retaining wall.
Figure 3:
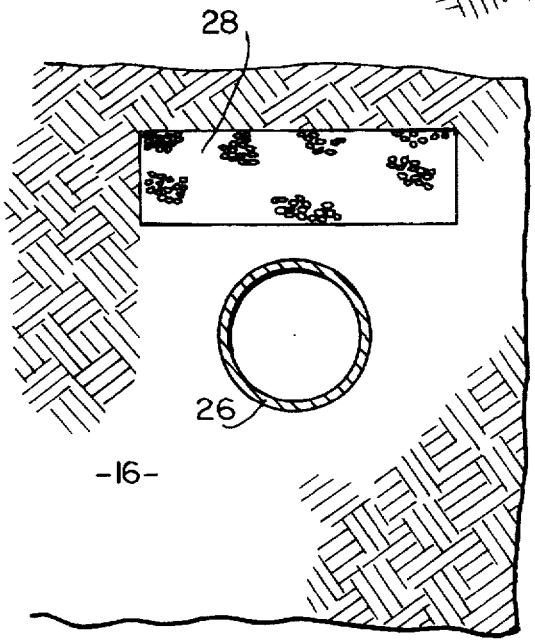
FIG. 3 is a cross sectional view of another context of the invention wherein an elasticized geofoam composition block is positioned above a buried concrete conduit.

An elasticized geosynthetic panel 20, in accordance with a preferred embodiment of the invention, is also shown in FIG. 1. In an operative posture, the elasticized geosynthetic panel 20 is positioned between ambient earth materials 16 and the rigid retaining wail 10 to operably compress under the horizontal stresses applied to the wail by the adjacent earth formation. This compressibility enables soil particle movement in the earth formation and concomitant shear strength mobilization within the retained soil. Controlled yielding has enabled some designs to achieve significantly reduced earth formation pressures on retaining walls, and the like.

Figure 2:
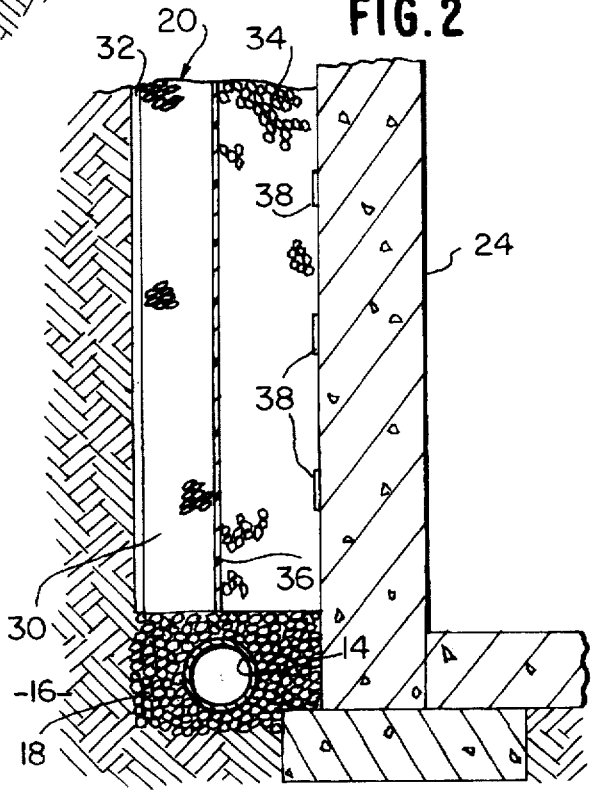
FIG. 2 is a cross sectional view of an elasticized geosynthetic panel composite, in accordance with the invention, containing a layer of elasticized expanded polystyrene in accordance with a preferred embodiment of the invention placed adjacent another rigid earth retaining structure such as a foundation wall.

In addition to retaining walls 10 the subject elasticized geosynthetic panel 20 can advantageously be used against foundation or basement walls 24 of buildings such as depicted in FIG. 2. Still further an geofoam block of elasticized expanded polystyrene can be used above a buried concrete pipe 26, culvert, small diameter tunnel, or the like and serve to permit controlled shear strength mobilization to relieve vertical stress on an underlying rigid earth retaining structure.

Elasticized Geosynthetic Panel

FIGS. 1 and 2 disclose views of the subject elasticized geoinclusion composite in accordance with a preferred embodiment of the invention. The subject geoinclusion composite is generally comprised of a drainage component or panel 30, a water and gas permeable membrane 36 and a compressible geofoam member 34.

The drainage component 30 is composed of beads or spheres of expanded polystyrene lightly bonded or fused together at random touching surface locations. This random arrangement creates void spacing that permits water and other liquids to flow through the drainage layer to relieve hydrostatic pressure buildup adjacent the associated wall surface.

Sphere fusing can be achieved by a steam fusion technique in a mold, or bonding can be accomplished with a light coating of a latex bituminous emulsion or similar adhesive. While a spherical configuration for the beads is preferred, other three dimensional configurations are contemplated by the subject invention such as cubes, solid rectangles, or other polyhedron configurations and the like as desired. In addition, materials other than polystyrene may be used in practicing the invention, such as polyisocyanurate, polyurethane and the like. The drainage layer may include a plastic core material or randomly woven plastic wire. In addition the drainage layer my include molded channels to direct water to an underlying drainage conduit 14.

A water permeable membrane 32, or geotextile, is adhesively attached to the drainage layer 30 by a light layer of adhesive or adhesive spots to restrict particles of the retained earth materials from entering the drainage layer. Suitable geotextiles include a regular or random weave of polypropylene, fiberglass, or similar drainage fabrics, that are chosen depending on the surrounding earth materials.

The compressible geofoam member 34 is composed of an elasticized expanded polystyrene. The elasticizing process will be discussed in detail below, however, the member 34 initially may be composed of an ASTM C578 classification expanded polystyrene (EPS) of Type I, II, VIII, IX or XI. These types of EPS have densities of 0.75 to 2.0 pounds per cubic foot. In a preferred embodiment the EPS of the compressible geofoam member is Type XI having a density of 0.75 pounds per cubic foot.

The EPS drainage layer typically has a density approximately equal to 2.0 pounds per cubic foot. This density is typically greater than that of the compressible component 34. The density of the drainage layer permits the layer to slightly compress in response to horizontal stress of adjacent earth materials, however, the degree to which the drainage layer compresses is relatively small and is not sufficient to produce all of the desired deformation required to induce shear mobilization of the retained earth materials. However, by combining the drainage component with the subject elasticized EPS the combination achieves an advantageous degree of compression suitable to reduce horizontal stress applied to rigid retaining wall surfaces which, in turn, decreases the likelihood of structural deformation or cracking or failure of the retaining wall. Moreover, as stated above, planned accommodation for a degree of horizontal deformation of the retained earth material mobilizes the shear strength of the earth material and tensile resistance of any synthetic reinforcement included therein.

The drainage component is preferably coextensive with the compressible member and is joined into an elasticized geosynthetic panel composite by an adhesive layer 36 or adhesive spots. The specific adhesive used must be compatible with the materials composing the drainage component and the compressible geofoam of elasticized expanded polystyrene, and this adhesive must also maintain the positioning of the two layers until completion of the installation procedures.

The elasticized geosynthetic panel is attached to a rigid retaining wall, or the like, adhesive spots 38. An alternative method of attaching the subject geosynthetic composite to a wall structure includes mounting a plurality of stick clips to the appropriate wall surface and impaling the layers on the stick clips. Additional methods include using various manual or power activated nailing systems to secure the layers, applying preformed tape with two self-adhering surfaces between the layers, or applying mechanical fasteners between the various layers.

Elasticized Geofoam Composition

FIGS. 4 though 8 disclose an "elasticized" geofoam block 40 and method of producing the novel geofoam composition and properties of the elasticized expanded polystyrene block 40.

Expanded polystyrene is formed by placing polystyrene pellets within an expander vessel where steam is injected to expand the pellets into spheres referred to as "prepuff" spheres. The prepuff EPS is then blown into a generally rectangular mold enclosure. A vacuum is drawn on the enclosure and additional steam is injected to heat the pellets. The heated spheres 42 self-adhere within the mold into a generally homogenous block of EPS which is approximately 98% air. Accordingly EPS material is light weight (densities of 0.75 to 2.0 pounds per cubic foot are typical as noted above) and exhibits a compressive resistance of from 5.0 pounds per square inch to 25 pounds per square inch. As shown in FIG. 4 a geofoam block of EPS has a length "L", width "W" and thickness "T" dimension which is typically 8 feet or 16 feet by 4 feet and a thickness of 30 inches. Other dimensions are, of course, possible but the above provides an EPS block that can be easily positioned at a work site by hand.

Blocks of EPS as described above exhibit a high strength to weight ration and are isotropic (same stress-strain properties in any direction of loading). Such EPS blocks have been used in the past as light weight fill material.

The subject invention includes a way of enhancing previously known EPS blocks by elasticizing the block prior to application which has the effect of converting the isotropic block into a mechanically anisotropic (different stress-strain properties depending on the direction of loading) geofoam composition.

The procedure by which this anisotropic property is effected is shown sequentially in FIGS. 5–7. FIG. 5 shows a side view of a segment of an EPS block 40 as previously known and as referred to in FIG. 4. As FIG. 5 depicts, the particles of expanded polystyrene 42, which from the block, are essentially spherical in shape. In this configuration, the expanded polystyrene is mechanically isotropic.

In FIG. 6 the block 40 is subjected to unidirectional compression forces normal to the largest surface area bounded by the length and width of the block. During this process, the spheres 42 of expanded polystyrene are transformed into ellipsoids 44. The amount of force necessary to effect compression varies with the size of the block and the Type of EPS used however it has been experimentally determined that a range of compression of from 80% to 50% produces a desired elasticizing effect. If compression is too light the desired elasticizing does not occur while compression that is too great crushes the EPS spheres. An optimal range is 60% to 70% compression and the most desirable single compression is 67% or two thirds of the original EPS block thickness.

Once the dimensional compression is achieved the forces "F" are released and the block 40 rebounds to approximately 85% of its original thickness as shown in FIG. 7. The individual EPS spheres 42 remain in a slightly elliptical configuration 46 and are elastic in the direction compression. The resulting elasticized block of EPS exhibits a higher density but unexpectedly this enhance or increased elasticity in the direction in which the compression force was applied. This results in an geofoam composition that is cross-anisotropic in that the greatest difference in stress-strain behavior is oriented 90% apart.

As seen by reference to FIG. 8 and contrary to expectation, the elasticized expanded polystyrene has a greater flexibility than "normal" expanded polystyrene. Compare the graph of Compressive Stress, reported in pounds per inch, versus Compressive Strain, reported in percentages, for normal (uncompressed) and elasticized (compressed) expanded polystyrene.

It is this uniquely, directional elasticized, expanded polystyrene which is used in the subject geosynthetic panel composite and geofoam composition blocks.

In another embodiment of the invention, the subject geoinclusion composite may be used in combination with synthetic reinforcements, such as layers, sheets, or strips of polymeric or metallic material, that are placed in one or more generally horizontal layers behind the earth retaining structure. The addition of synthetic reinforcements to earth material retained by a structure is generally referred to as mechanically stabilized earth. The compressibility of the subject geoinclusion composite permits the earth materials and the synthetic reinforcements to deform in instances where the rigidity of the structure would have previously prevented deformation, rendering the reinforcement of little or no technical benefit. In certain situations, the combination of the subject elasticized geosynthetic composite with synthetic reinforcements can eliminate the earth pressure that would otherwise be input onto a wall structure.

SUMMARY OF MAJOR ADVANTAGES OF THE INVENTION

After reading and understanding the foregoing elasticized geosynthetic composite panel and geofoam composition, in conjunction with the drawings, it will be appreciated that several distinct advantages of the subject invention are obtained. Without attempting to set forth all of the desirable features of the subject elasticized EPS composite and geofoam block, at least some of the major advantages of the invention include the provision of a compressible layer of elasticized expanded polystyrene which compresses to permit soil deformation and concomitant controlled yielding of the retained earth materials. When the earth materials are subjected to additional forces or stresses caused by transient external events such as vehicle traffic, earth tremors, or explosive blasts, etc., the compressible layer of elasticized expanded polystyrene ads a shock absorber to reduce the subsequent increase in lateral pressure due to the transient event.

The present invention makes use of the newly created anisotropic properties of an expanded polystyrene block. These properties are what permits the compressible layer to compress the most and still protect the integrity of the structure. The relative density of the subject geoinclusion composite provides for the compressibility of an inner layer while maintaining the structural integrity and openness of a drainage panel.

In another aspect of the invention, the subject elasticized geoinclusion composite includes, in combination, a drainage layer that eliminates hydrostatic pressure buildup against a subterranean wall, retaining wall, or the like. Eliminating hydrostatic pressure buildup reduces the likelihood of cracking or failure of the wall surface. The subject elasticized geosynthetic composite also serves as an insulator between the retained earth materials and an associated wall structure. If the elasticized geosynthetic composite is used in conjunction with a subterranean wall defining the foundation of a building the invention maintains the temperature differential between the occupiable space and the earth materials. Without the insulation, it would be necessary to heat or cool a mass of earth material surrounding the foundation to maintain the desired temperature within the occupied space. In most cases, the surrounding earth creates a heat sink approximately equal to 55 degrees Fahrenheit. In such situations, the insulative aspect of the invention transfers the dew point to the soil side of the subterranean wall. Accordingly, the dampness and musty odor typical of many below-ground spaces is reduced.

If the geoinclusion is used in conjunction with a retaining wall, bridge abutment, or similar structure such that the exterior face of the wall is subjected to warming by solar radiation, the subject geoinclusion composite will significantly reduce the propagation of heat through the wall and into the retained soil. This is important in situations where the retained earth material contains mechanically stabilized earth because the creep rate and concomitant loss of strength of polymeric materials increases significantly with increases in temperature. Thus, the geoinclusion composite permits safer and more efficient use of polymeric reinforcements.

Because the materials that comprise the compressible layer and the drainage layer have resilient properties, the subject elastomeric geosynthetic composite serves to attenuate noise and/or vibrations created by vehicular or rail traffic, mechanical equipment or the like.

In describing the invention, reference has been made to preferred embodiments. Those skilled in the art, however, and familiar with the disclosure of the subject invention, may recognize additions deletions, substitutions, modifications, and or other changes that will fall within the purview of the invention as defined in the claims below.

What is claimed is:

1. An elasticized geosynthetic panel composite for inclusion in subterranean applications permitting deformation of earth materials to promote shear strength mobilization of the earth materials adjacent an essentially fixed earth retaining structure comprising:

a drainage component composed of a composition that permits water or gas to flow from an earth formation into the drainage component and through the drainage component when said panel composite is placed in a subterranean application;

a water and gas permeable membrane extending coextensively with said drainage component and being operable to restrict particles of earth material from a subterranean environment from flowing into said drainage component which might tend to clog the passage of water or gas through said drainage component; and a compressible geofoam member extending generally coextensively with said drainage component and being operable to extend between a fixed subterranean earth formation and said drainage component and being composed of an elasticized geosynthetic material comprising an expanded polystyrene solid, generally rectangular, block having a length, width and thickness which has been loaded with a single compression normal to the largest planar surface of the block to compress the block along its thickness axis to between 50 and 80 percent of its original physical thickness dimension and then release the single compression to enable the block to rebound in the direction of its original configuration such that said block exhibits a mechanical cross-anisotropy and an increase in both density and compressibility to permit shear strength mobilization of earth materials in a subterranean application.

2. An elasticized geosynthetic panel composite for inclusion in subterranean applications permitting deformation of earth materials to promote shear strength mobilization of the earth materials adjacent an essentially fixed earth retaining structure as defined in claim 1 wherein:

said compressible member comprises an expanded polystyrene generally solid rectangular block being laterally loaded and compressed along the thickness dimension to between 60 and 70 percent of its at rest physical thickness and then released to rebound in the direction of its original thickness.

3. An elasticized geosynthetic panel composite for inclusion in subterranean applications permitting deformation of earth materials to promote shear strength mobilization of the earth materials adjacent an essentially fixed earth retaining structure as defined in claim 2 wherein:

said compressible member being laterally loaded and compressed to 67 percent of its at rest physical thickness and then released to rebound in the direction of its original thickness.

4. An elasticized geosynthetic panel composite for inclusion in subterranean applications permitting deformation of earth materials to promote shear strength mobilization of the earth materials adjacent an essentially fixed earth retaining structure as defined in claim 3 wherein:

said expanded polystyrene rebounding, following compression, to approximately 85 percent of its original thickness.

5. An elasticized geofoam composition for inclusion in subterranean applications permitting deformation of earth materials to promote shear strength mobilization of the earth materials adjacent an essentially fixed earth retaining structure comprising:

a generally rectangular block of an expanded polystyrene composition, said block having a width, length and thickness, said block being compressed in a direction normal to its largest face defined by the width and length dimensions until the block is reduced in thickness between 50 to 80 percent of its original thickness dimension with a single compression and then the single compression is released to enable the block to rebound in the direction of its original thickness configuration wherein the resulting expanded polystyrene block is mechanically cross-anisotropic with an increase in density and an increase in compressibility in the direction of the thickness of the block to promote shear strength mobilization of earth materials in a subterranean application.

6. An elasticized geofoam composition for inclusion in subterranean applications permitting deformation of earth materials to promote shear strength mobilization of the earth materials adjacent an essentially fixed earth retaining structure as defined in claim 5 wherein:

said expanded polystyrene block is compressed to between 60 and 70 percent of its original thickness and then released.

7. An elasticized geofoam composition for inclusion in subterranean applications permitting deformation of earth materials to promote shear strength mobilization of the earth materials adjacent an essentially fixed earth retaining structure as defined in claim 6 wherein:

said expanded polystyrene block is compressed to 67 percent of its original thickness and then released.

8. An elasticized geofoam composition for inclusion in subterranean applications permitting deformation of earth materials to promote shear strength mobilization of the earth materials adjacent an essentially fixed earth retaining structure as defined in claim 5 wherein:

said generally solid rectangular block of an expanded polystyrene composition rebounds, following compression to approximately 85 percent of its original thickness.

* * * * *